US005685369A

United States Patent [19]

Ellis et al.

[11] Patent Number: 5,685,369

[45] Date of Patent: Nov. 11, 1997

[54] METAL SEAL WELL PACKER

[75] Inventors: Steven C. Ellis, Aberdeenshire; Allan C. Sharp, Aberdeen; Stephen Reid, Aberdeen; Richard P. Rubbo, Aberdeen, all of Scotland

[73] Assignee: ABB Vetco Gray Inc., Houston, Tex.

[21] Appl. No.: 641,598

[22] Filed: May 1, 1996

[51] Int. Cl.[6] ..... E21B 33/12

[52] U.S. Cl. ..... 166/195; 166/217

[58] Field of Search ..... 166/208, 217, 166/182, 195, 123

[56] References Cited

U.S. PATENT DOCUMENTS

| | | | |
|---|---|---|---|
| 3,637,223 | 1/1972 | Weber . | |
| 4,127,168 | 11/1978 | Hanson et al. . | |
| 4,178,992 | 12/1979 | Regan et al. . | |
| 4,288,082 | 9/1981 | Setterberg, Jr. . | |
| 4,515,213 | 5/1985 | Rogen et al. . | |
| 4,531,581 | 7/1985 | Pringle et al. . | |
| 4,573,537 | 3/1986 | Hirasuna et al. . | |
| 4,601,498 | 7/1986 | Haugen . | |
| 4,619,326 | 10/1986 | van Mierlo . | |
| 4,641,708 | 2/1987 | Wightman | 166/208 |
| 4,651,818 | 3/1987 | Johnson et al. . | |
| 4,665,979 | 5/1987 | Boehm, Jr. | 166/208 |
| 4,714,111 | 12/1987 | Brammer | 166/182 |
| 4,907,651 | 3/1990 | Bou-Mikael . | |
| 4,949,786 | 8/1990 | Eckert et al. | 166/208 |
| 4,960,172 | 10/1990 | Nelson | 166/208 |
| 5,060,724 | 10/1991 | Brammer et al. | 166/208 |
| 5,067,734 | 11/1991 | Boehm, Jr. . | |
| 5,211,226 | 5/1993 | Hendrickson et al. . | |
| 5,327,965 | 7/1994 | Stephen et al. | 166/208 |
| 5,333,692 | 8/1994 | Baugh et al. . | |
| 5,456,314 | 10/1995 | Boehm, Jr. et al. . | |

*Primary Examiner*—Frank Tsay
*Attorney, Agent, or Firm*—James E. Bradley

[57] ABSTRACT

A well packer has a metal seal which seals between the packer mandrel and the casing. The metal seal includes a seal sleeve located on the exterior of the mandrel. The sleeve has an inner wall and an outer wall radially separated by a channel. The inner channel is initially separated from the exterior of the mandrel by a clearance. An energizing ring is sizably mounted to the mandrel for axial movement relative to the mandrel. Initially, the energizing ring will be located at the entrance of the channel. An actuating device moves the energizing ring into the channel, wedging the walls of the seal sleeve apart. The inner wall seals against the mandrel. The outer wall seals against the casing.

9 Claims, 3 Drawing Sheets

METAL SEAL WELL PACKER

BACKGROUND OF THE INVENTION

1. Field of the Invention

This invention relates in general to oil and gas well downhole production equipment, and in particular to a packer that has a metal seal for sealing against the casing.

2. Description of the Prior Art

An oil well packer is a device that is set downhole to separate a zone below from a zone above. The packer has a seal element which seals against casing. The packer will be connected to production tubing, sealing the annulus surrounding the tubing.

There are many varieties of packers. Packers generally include set of slips which grip the casing and a packer element which seals against the casing. Normally, the packer element is an elastomer. However, some wells have temperatures of 450 degrees F., and at these temperatures, elastomers are not suitable. Metal seal packer elements are known. Metal seals are longer lasting and will withstand higher temperatures and pressures than elastomers. However, it is difficult to form a high pressure seal against the casing bore with a metal seal. The casing has an interior surface that is not machined for sealing. The bore may have scratches, pits and other irregularities that are not conducive to a high pressure metal seal. Some wells require that the packer be able to seal 20,000 psi.

Additionally, slight axial movement between the casing and the packer may occur after installation, such as during hydraulic fracturing operations. The pumping action creates pressure pulses of 60 to 120 cycles per minute. This relative movement is detrimental to metal seals.

SUMMARY OF THE INVENTION

A metal seal packer element is provided in this invention. The packer has a tubular mandrel which secures to a string of tubing. A metal seal sleeve is carried on the exterior of the mandrel. The seal sleeve has inner and outer walls which are radially separated by a channel. Also, the inner wall is radially separated from the exterior of the mandrel by a clearance. An energizing ring slidably mounts to the mandrel for axial movement. While in the running-in position, the energizing ring is located at the entrance of the channel of the setting sleeve. The energizing ring has a greater radial thickness than the initial width of the channel. An actuating means will move the energizing ring axially relative to the seal sleeve, so that it enters the channel and wedges the inner and outer walls apart from each other. This causes the inner wall to seal against the exterior of the mandrel and the outer wall to seal against the interior of the casing.

In the preferred embodiment, the mandrel has a set of wickers on its exterior. The inner wall of the seal sleeve embeds within the wickers when set. Also, preferably, the outer wall of the seal sleeve has a plurality of bands which protrude from the outer surface. These bands provide recesses between them. An inlay of soft metal is located in the recesses. The bands deform when the outer wall is pressed into sealing engagement with the casing hanger.

DETAILED DESCRIPTION OF THE PREFERRED EMBODIMENT

Figure 2:
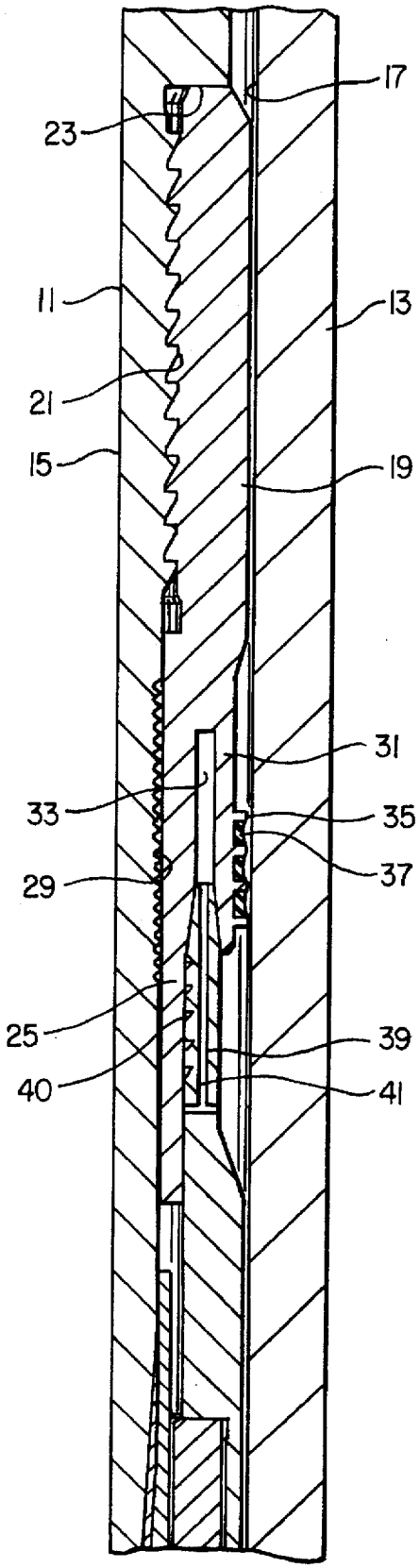
FIG. 2 is an enlarged quarter-sectional view of the seal portion of the packer of FIGS. 1A–1E.

Referring first to FIG. 2, the sealing portion of the packer is shown in enlarged detail. The packer has a mandrel 11 which extends along the longitudinal axis. Mandrel 11 is a tubular member which is lowered within the casing 13 of the well. Mandrel 11 has a bore 15. A seal sleeve 19 having an outer diameter slightly less than the inner diameter 17 of casing 13, is carried on the exterior of mandrel 11. Seal sleeve 19 is secured to mandrel 11 by a set of threads 21. The upper end of seal sleeve 19 makes up against a downward facing make-up shoulder 23 formed on mandrel 11. During assembly, seal sleeve 19 is tightened to a selected preload against make-up shoulder 23, so as to assure that there will be no axial movement of seal sleeve 19 relative to mandrel 11 during the setting action.

Seal sleeve 19 has a cylindrical inner wall 25 that extends downward and has an inner diameter that is slightly greater than the outer diameter of mandrel 11 at that point. A set of wickers 29 are formed on the exterior of mandrel 11 and surrounded by seal sleeve inner wall 25. Wickers 29 are parallel circumferentially extending parallel grooves, not threads. Wickers 29 are preferably triangular in cross-section and have a pitch of about ⅛th inch. An initial clearance exists between wickers 29 and inner wall 25 during the running-in position which is shown in FIG. 2.

Seal sleeve 19 has an outer wall 31 that is cylindrical and spaced radially outward from inner wall 25. In the embodiment shown, outer wall 31 does not extend downward as far as inner wall 25, terminating about one-half the length of inner wall 25. An annular channel 33 exists between inner wall 25 and outer wall 31.

A plurality of bands 35 protrude from the exterior of outer wall 31. Bands 35 are parallel, circumferential, metal ribs integrally formed with the body of outer wall 31. The outer diameter of bands 35 is slightly less than the inner diameter 17 of casing 13 during running-in. Seal sleeve 19, and thus bands 35, has a lesser hardness or yield strength than casing 13, preferably about one-half. The yield strength for casing 13 for high pressure, high temperature wells is typically in excess of 100,000 psi, and preferably about 125,000 psi. Similarly, mandrel 11, and thus wickers 29, has a greater hardness or yield strength than inner wall 25, preferably about twice.

Bands 35 have recesses between them which are partially filled with an inlay 37 of soft metal such as a lead/tin alloy. Inlay 37 has to have the ability to withstand well temperatures up to 450 degrees F., but be capable of soldering or flame spraying. Inlay 37 has a lesser hardness or yield strength than the hardness of bands 35, preferably about one-fourth. Inlay does not completely fill the recesses between the bands 35, rather a V-shaped groove is formed within the outer surface of each inlay 37. The amount of inlay 37 is selected so that when bands 35 deform, decreasing the volume of the recesses, inlay 37 will substantially fill the decreased volume and will not significantly extrude out past bands 35. Inlay 37 lubricates the seal during the setting action and also during slight relative movement due to cyclic movement that occurs after setting.

An energizing ring 39 is located below seal sleeve 19 for performing the setting action. Energizing ring 39 has a tapered upper nose that locates within a tapered section at the entrance of channel 33. The radial thickness of energizing ring 39 is greater than the radial dimension of channel 33 so that it will wedge inner and outer walls 25, 31 apart when forced into channel 33. A plurality of saw-toothed shaped grooves 40 are located on the inner diameter of energizing ring 39. When energizing ring 39 is forced into channel 33, grooves 40 grip the outer diameter of inner wall 25 to anchor energizing ring 39 in the set position. Displacement passage 41 allows for the displacement of fluid from channel 33 when energizing ring 39 moves into channel 33. During the setting action, an actuating means which will be described subsequently moves energizing ring 39 upward into channel 33. This movement wedges inner and outer walls 25, 31 radially apart. Inner wall 25 embeds permanently into wickers 29, forming a metal-to-metal seal. Bands 35 deflect and permanently deform against inner diameter 17 of casing 13, forming a metal-to-metal seal. After installation, such as during hydraulic fracturing operations, some axial movement between seal sleeve 19 and casing 17 might occur. Inlay 37 provides lubrication and helps maintain sealing against inner diameter 17 of casing 13.

The remaining portions of the packer do not form a part of the invention being claimed, but are shown to illustrate one means for actuating seal sleeve 19. Mandrel 11 is secured at its upper end to a string of tubing 43 that extends to the surface. In the embodiment shown, mandrel 11 has a set of upper ramps 45 which support a set of upper slips 47. An upper coil spring 49 when released will provide energy to force slips 47 upward on ramps 45 to grip casing 13 (FIG. 2). An upper spring housing 51 surrounds upper spring 49.

Figure 1A:
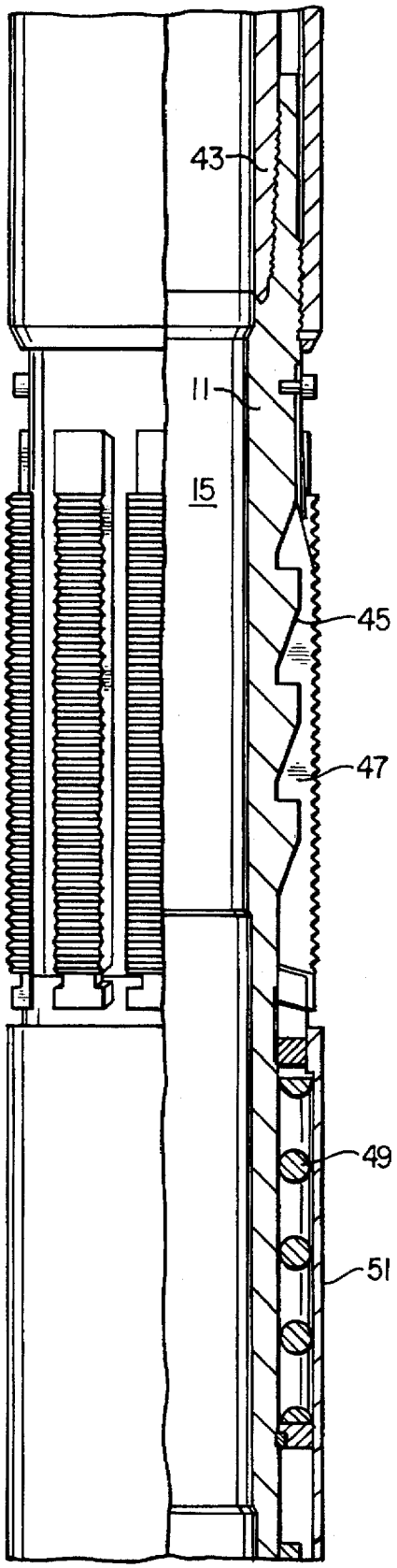
FIGS. 1A–1E comprise a vertical sectional view of a packer constructed in accordance with this invention.
Figure 1B:
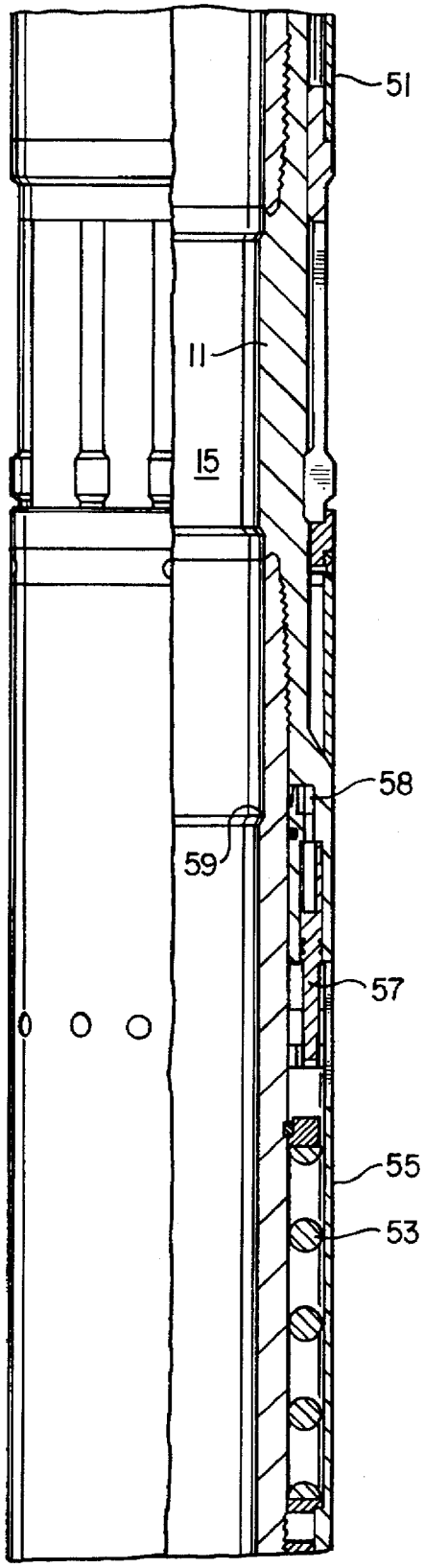
Figure 1C:
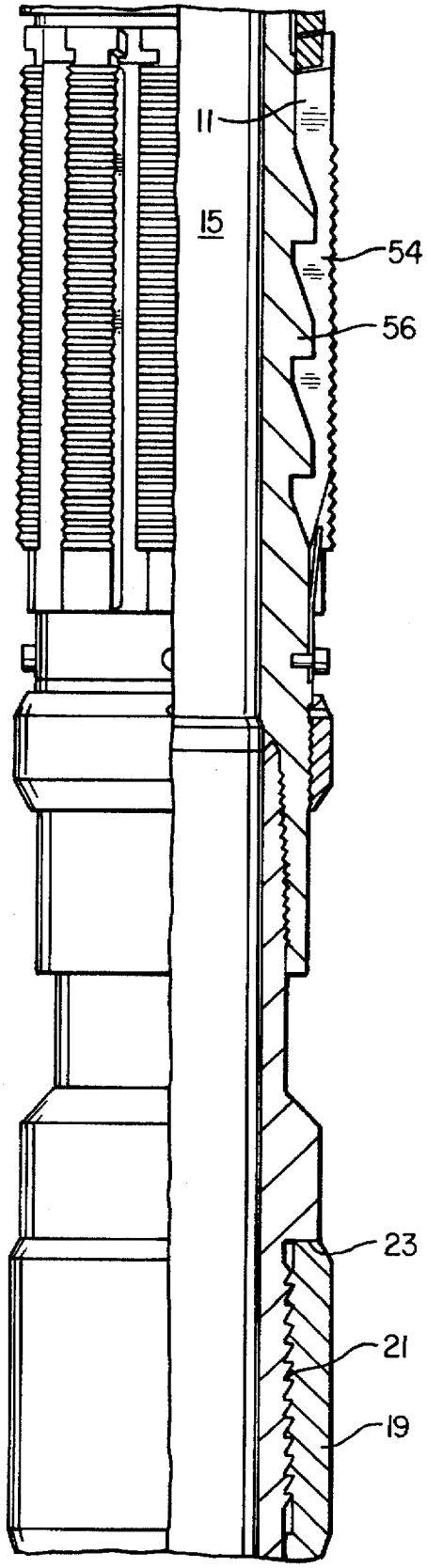

Referring to FIG. 1B, a lower spring 53 is carried below upper spring 49. Lower spring 53 is also a coil spring, however it operates downward to actuate a set of lower slips 54 (FIG. 1C). Lower slips 54 are carried on lower ramps 56. Lower spring 53 (FIG. 1B) is surrounded by a lower spring housing 55.

Slips 47, 54 are shown in the running-in position. Springs 49, 53 are restrained from moving slips 47, 54 to the setting position. In the embodiment shown, the means to release springs 49, 53 comprises an explosive bolt 57. Explosive bolt 57 is connected to a detonator and coil assembly 58. To set the packer, an electrical coil (not shown) is lowered through the tubing by a wireline onto a locator shoulder 59 adjacent coil assembly 58. When supplied with current, electrical power is induced into coil assembly 58, which ignites a detonator to part bolt 57. This releases coil springs 49, 53 to move slips 47, 54 to a setting position gripping casing 13 (FIG. 2). Slips 47, 54 prevent relative movement between mandrel 11 and casing 13 once set.

Figure 1D:
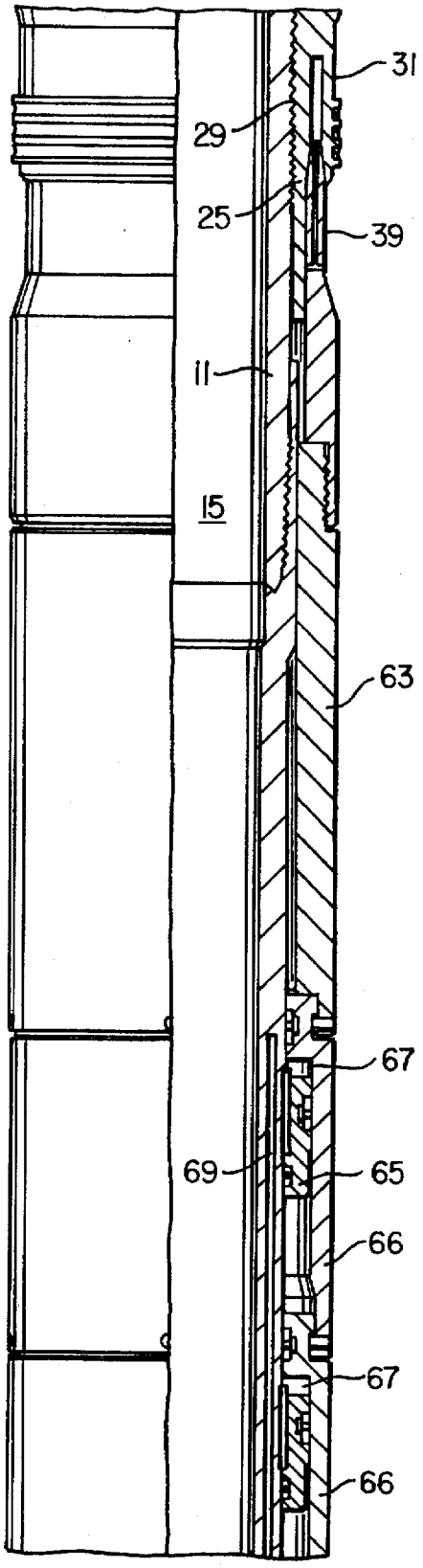
Figure 1E:
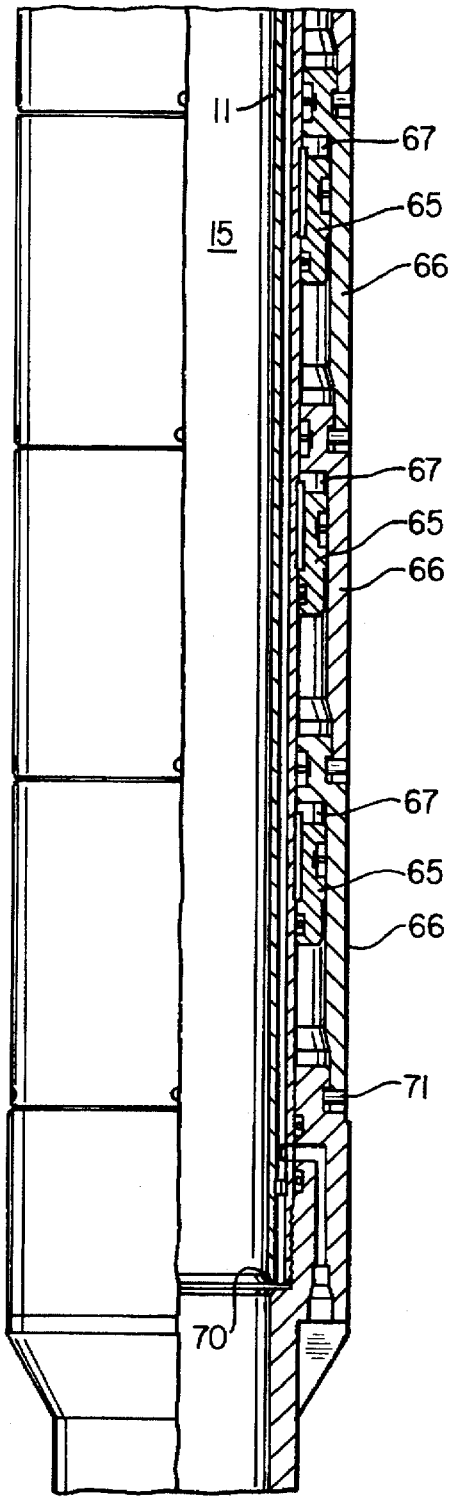

Referring to FIG. 1D, after slips 47, 54 have been set, seal sleeve 19 will be set. In this embodiment, this is handled by an actuating sleeve 63, which is secured to the lower end of energizing ring 39. Actuating ring 63 is driven by a number of pistons 65. Pistons 65 are rigidly secured to the exterior of mandrel 11. A movable cylinder 66 surrounds each piston 65. Each cylinder 66 is secured rigidly by screws to each other, with the upper one being rigidly secured to actuating sleeve 63. A pressure chamber 67 is formed within each cylinder 66 above each piston 65. A communication passage 69 is located within mandrel 11 for communicating mandrel bore 15 with pressure chambers 67. The lower end 70 (FIG. 1E) of communication passage 69 is open to mandrel bore 15. High pressure fluids, up to 10,000 psi, are pumped down the tubing and supplied to the bore 15 of mandrel 11. Passages (not shown) lead from each pressure chamber 67 to communication passage 69. A shear screw 71 holds cylinders 66 in an initial lower running-in position. From the application of high pressure to bore 15, shear screw 71 will shear because of the high pressure in pressure chambers 67. This forces cylinders 66 upward, and along with them actuating sleeve 63 and energizing ring 39. This sets seal sleeve 19. Then, the pressure may be relieved as the wedging of energizing ring 39 into channel 33 (FIG. 2) is permanent.

The invention has significant advantages. The metal seal will effectively seal against casing. It withstands high temperatures and high pressures. It has a long life and is capable of accommodating slight movement due to cyclic loading.

While the invention is shown in only one of its form, it should be apparent to those skilled in the art that it is not so limited but is susceptible to various changes without departing from the scope of the invention.

We claim:

1. A well packer, comprising in combination:

a tubular mandrel having a longitudinal axis and adapted to be secured to a string of tubing and lowered into a casing within the well;

a metal seal sleeve on the exterior of the mandrel, the sleeve having an inner wall and an outer wall radially separated by a channel which has an initial width, the inner wall being initially radially separated from the exterior of the mandrel by a clearance; and an energizing ring slidably mounted to the mandrel for axial movement relative to the mandrel from a running-in position at an entrance of the channel to a setting position located within the channel, the energizing ring being of greater radial thickness than the initial width of the channel so that it wedges the inner and outer walls apart when moved to the setting position, deforming the inner wall into engagement with the exterior of the mandrel and the outer wall into engagement with the casing.

2. The packer according to claim 1 wherein the mandrel has a set of wickers located adjacent the inner wall of the sleeve, and wherein when the energizing ring is moved to the setting position, the inner wall of the sleeve permanently embeds into the wickers.

3. The packer according to claim 1 wherein:

the sleeve has a plurality of parallel, circumferential bands protruding from its outer wall, defining annular recesses between the bands; and inlay of soft metal filled within the recesses; and wherein the bands permanently deform into engagement with the casing when the energizing ring is moved to the setting position.

4. The packer according to claim 1 wherein the entrance to the channel faces downward and the energizing ring moves upward when moving from the running-in position to the setting position.

5. A well packer, comprising in combination:

a tubular mandrel having a longitudinal axis and adapted to be secured to a string of tubing and lowered into a casing within the well, the mandrel having an exterior surface containing a set of wickers;

a metal seal sleeve on the exterior of the mandrel, the sleeve having an inner wall and an outer wall radially separated by a channel which has an initial width, the inner wall being initially radially separated from the wickers by a clearance;

a plurality of circumferentially extending protruding bands on the exterior of the outer wall, defining annular recesses located between the bands, the recesses containing an inlay of soft metal; and an energizing ring slidably mounted to the mandrel for axial movement relative to the mandrel from a running-in position at an entrance of the channel to a setting position located within the channel, the energizing ring being of greater radial thickness than the initial width of the channel so that it wedges the inner and outer walls apart when moved to the setting position, permanently embedding the inner wall into the wickers and permanently deforming the bands against the casing.

6. The packer according to claim 5 wherein:

the exterior of the packer has a make-up shoulder facing the seal sleeve and a set of threads adjacent the shoulder; and the sleeve has a mating set of threads and a make-up shoulder and is mounted to the exterior of the body by mating engagement of the threads and make-up shoulders of the packer and the sleeve.

7. The packer according to claim 5 wherein the entrance to the channel faces downward and the energizing ring moves upward when moving from the running-in position to the setting position.

8. In a well packer for installation in a casing, having a tubular mandrel which has a longitudinal axis and is adapted to be secured to a string of tubing and lowered into a casing within the well, a set of slips carried by the mandrel, slip setting means for moving the slips from a collapsed running-in position to a setting position in engagement with the casing, seal means for sealing between the mandrel and the casing, and actuating means for moving the seal member from a running-in position to the setting position, the seal means comprising in combination:

a set of wickers formed on the mandrel;

a metal seal sleeve on the exterior of the mandrel, the sleeve having an inner wall and an outer wall radially separated by a channel which has an initial width, the inner wall being initially radially separated from the wickers by a clearance;

a plurality of circumferentially extending protruding bands on the exterior of the outer wall, defining annular recesses located between the bands, the recesses containing an inlay of soft metal; and wherein the actuating means comprises in combination:

an energizing ring slidably mounted to the mandrel and being of greater radial thickness than the width of the channel; and means for axially moving the energizing ring upward from a running-in position at an entrance of the channel to a setting position located within the channel, wedging the inner and outer walls apart, permanently embedding the inner wall into the wickers and permanently deforming the bands against the casing.

9. The packer according to claim 8 wherein:

the exterior of the packer has a make-up shoulder facing the seal sleeve and a set of threads adjacent the shoulder; and the sleeve has a mating set of threads and a make-up shoulder and is mounted to the exterior of the body by mating engagement of the threads and make-up shoulders of the packer and the sleeve.

* * * * *